US005727630A

United States Patent [19]

Brammer

[11] Patent Number: 5,727,630

[45] Date of Patent: Mar. 17, 1998

[54] TELESCOPIC JOINT CONTROL LINE SYSTEM

[75] Inventor: Ashley N. M. Brammer, Aberdeen, Scotland

[73] Assignee: ABB Vetco Gray Inc., Houston, Tex.

[21] Appl. No.: 694,551

[22] Filed: Aug. 9, 1996

[51] Int. Cl.[6] ..... E21B 17/07

[52] U.S. Cl. ..... 166/355

[58] Field of Search ..... 166/355, 344, 166/345, 346, 347

[56] References Cited

U.S. PATENT DOCUMENTS

| | | | |
|---|---|---|---|
| 3,643,751 | 2/1972 | Crickmer | 166/355 |
| 3,820,600 | 6/1974 | Baugh | 166/344 |
| 3,955,621 | 5/1976 | Webb | 166/355 |
| 3,957,079 | 5/1976 | Whiteman . | |
| 4,364,433 | 12/1982 | Fisher et al. | 166/344 |
| 4,403,658 | 9/1983 | Watkins . | |
| 4,428,433 | 1/1984 | Watkins . | |
| 4,502,543 | 3/1985 | Outhwaite . | |
| 4,592,426 | 6/1986 | Neeley . | |
| 4,712,620 | 12/1987 | Lim et al. | 166/355 |
| 4,726,424 | 2/1988 | Raulins . | |

FOREIGN PATENT DOCUMENTS

| | | | |
|---|---|---|---|
| 2086452 | 5/1982 | United Kingdom | 166/344 |

*Primary Examiner*—Hoang C. Dang
*Attorney, Agent, or Firm*—James E. Bradley

[57] ABSTRACT

A telescopic joint for an upper end of an offshore drilling riser is installed and controlled remotely. The telescopic joint has inner and outer telescoping barrels. A mandrel is located on the lower end of the outer barrel, the mandrel landing within a support ring which is supported by constant tension cables extending from the vessel. Control fluid passages are located in the mandrel for registering with control fluid passages in the support ring. Permanent control fluid lines extend between various points of the outer barrel and the mandrel. Control fluid hoses connect the support ring to the vessel. Fluid communication is achieved once the telescopic joint is oriented and landed in the support ring.

15 Claims, 3 Drawing Sheets

TELESCOPIC JOINT CONTROL LINE SYSTEM

TECHNICAL FIELD

This invention relates in general to offshore drilling equipment, and in particular to a telescopic joint for a drilling riser to accommodate wave motion.

BACKGROUND ART

One type of offshore drilling technique uses a floating vessel which moves upward and downward with wave movement. A riser is fixed to the wellhead at the sea floor and extends upward to the vessel. A support ring suspended below the vessel by constant tension cables supports the upper end of the riser in tension. A telescopic joint lands in the support ring and connects to a conduit which extends to the vessel.

The telescopic joint has an inner barrel and an outer barrel which will slide axially relative to each other due to wave motion. The outer barrel has a mandrel at its lower end which is an enlarged cylindrical member that locates within the support ring of the riser. Drilling fluid will flow up through the riser and inner barrel to a diverter or blowout preventer at the vessel. One type of telescopic joint has a packer assembly located in it to seal between the inner and outer barrels in the event that the diverter needs to be closed. The packer assembly is actuated by control fluids supplied from the vessel.

Telescopic joints typically have other lines that lead to the vessel for other purposes. Supplying a coolant fluid, such as water, in the interface between the inner and outer barrels is used to reduce heat generation. A lock member hydraulically actuated from the drifting vessel is used to lock the inner and outer barrels together in the retracted position. Consequently, several lines will need to be connected between the telescopic joint and the drilling vessel to supply the various fluids.

In the prior art, the various lines were manually connected to the telescopic joint after it is installed on the upper end of the riser and landed in the support ring below the vessel rig floor. This requires lowering a worker into a dangerous area below the drifting vessel rig floor. It also is time consuming and must be done at least once per well.

DISCLOSURE OF INVENTION

In this invention, the telescopic joint has a plurality of control fluid passages in the mandrel. A control fluid line leads from each of the passages to one of the control fluid ports in the outer barrel, such as the ports for the locking member, the cooling fluid, and the packers. These control fluid lines remain permanently connected to the mandrel and outer barrel, even prior to connecting the telescopic joint to the riser.

The mandrel has passages which lead from the connection with the control fluid lines to a cylindrical exterior surface on the mandrel. This cylindrical exterior surface is received within the support ring which supports the upper end of the riser. The support ring has control fluid passages in it which register with the control fluid passages in the mandrel. Hoses are permanently connected from the vessel to the support ting for supplying control fluid to the telescopic joint.

BEST MODE FOR CARRYING OUT THE INVENTION

Figure 1:
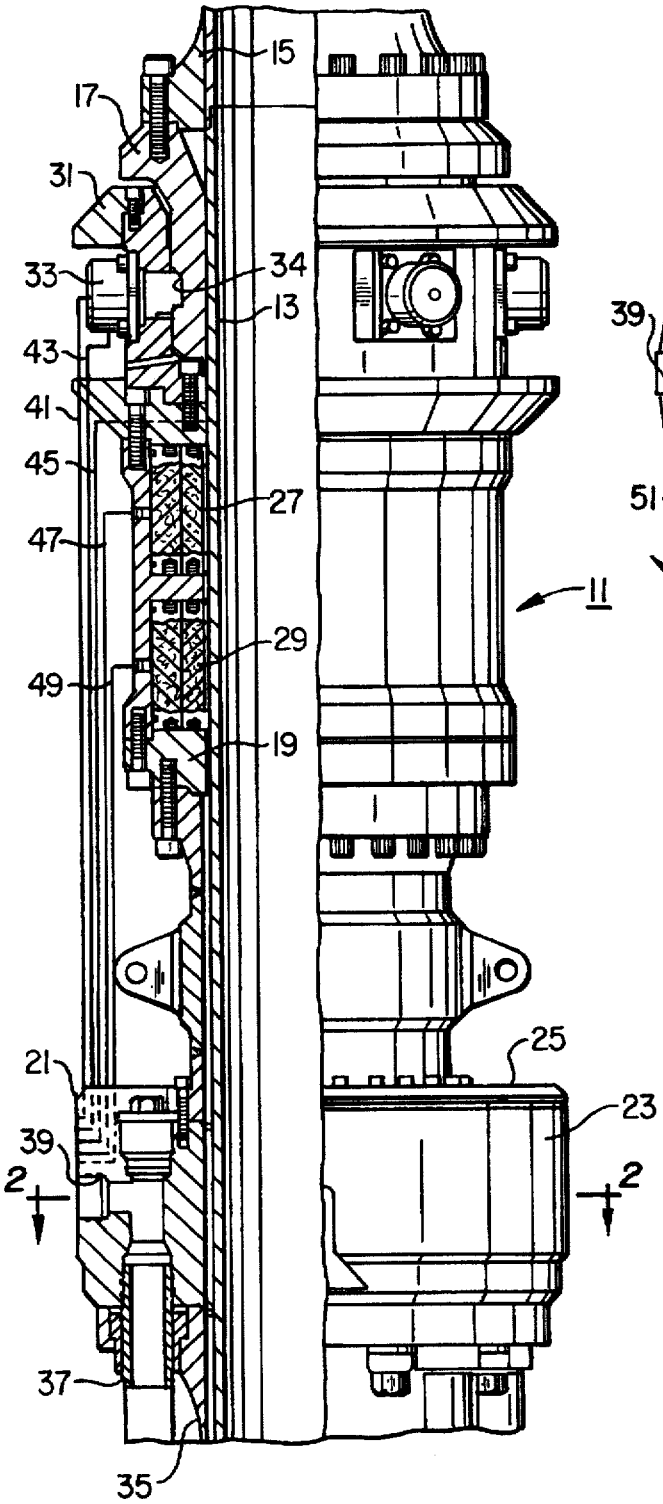
FIG. 1 is a partial sectional view of a telescopic joint constructed in accordance with this invention.

Referring to FIG. 1, telescopic joint 11 has an inner barrel 13 which is a large tubular member having an axial bore through it. The upper end of inner barrel 13 is connected to a conduit 15 which typically leads to a diverter (not shown), which is a type of blowout preventer mounted to the vessel below the rig floor. Inner barrel 13 moves upward and downward in unison with the vessel due to wave motion. A downward extending collar 17 is secured to conduit 15 and encloses an upper end portion of inner barrel 13.

An outer barrel 19 made up of a number of different parts encloses inner barrel 13. Outer barrel 19 includes a mandrel 21 at its lower end. Mandrel 21 is a tubular member having a bore through which inner barrel 13 extends. Mandrel 21 has a cylindrical exterior surface 23 and a flat upper side 25. A set of packers is secured above mandrel 21 and forms a part of outer barrel 19. In the embodiment shown, there are two packers, upper packer 27 and lower packer 29. Packers 27 and 29 are shown in a retracted position, which is the normal position. When pressurized fluid is supplied, the elastomers of packers 27, 29 extend inward and sealingly engage inner barrel 13. In the embodiment shown, upper packer 27 is energized by air pressure, while lower packer 29 is energized by hydraulic fluid pressure.

A collar 31 forms the upper end of outer barrel 19. Collar 31 extends upward and receives within it collar 17. A plurality of locking dogs 33 are mounted to collar 31 and are movable between an extended position, which is shown, and a retracted position. In the extended position, dogs 33 engage a recess 34 on inner barrel 13 to rigidly lock inner barrel 13 to outer barrel 19 while barrels 13, 19 are in a contracted position. Mandrel 21 is connected to the upper end of a string of riser 35 that extends to a wellhead (not shown) at the sea floor. Wave motion does not cause upward and downward movement of outer barrel 19 because of its connection through riser 35 to the subsea wellhead. A plurality of well control lines 37 extend upward alongside and form a part of riser 35. Three well control lines 37 are shown in this embodiment and are used to supply well control fluids for controlling the well, such as to a blowout preventer assembly (not shown) located at the lower end of the riser.

Telescopic joint 11 has a number of ports for receiving control fluids for different purposes. Each of the ports is connected to a separate control fluid line. Line 41 supplies hydraulic fluid for moving locking dogs 33 to an extended locking position. Line 43 supplies hydraulic fluid for moving locking dogs 33 to a retracted position. Line 45 supplies cooling fluid, such as water, to an interface between outer barrel 19 and inner barrel 13. Line 47 supplies pressurized air to upper packer 27 to cause it to energize. Line 49 supplies hydraulic fluid to lower packer 29 to cause it to energize. Lines 41, 43, 45, 47, and 49 are located on the exterior of outer barrel 19 and are secured at their lower ends to upper side 25 of mandrel 21.

Figure 2:
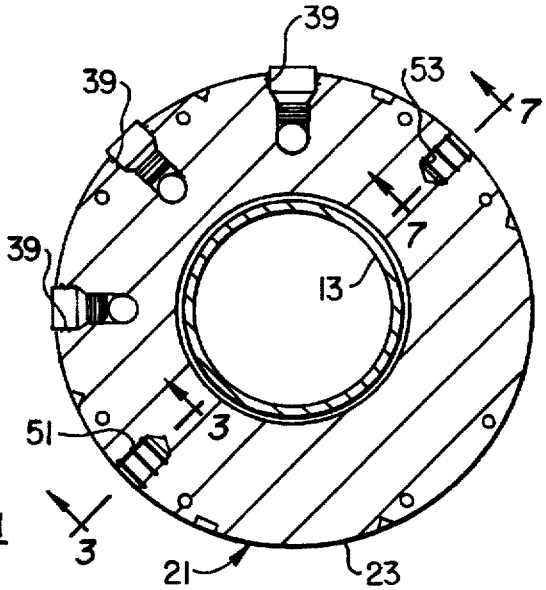
FIG. 2 is a sectional view of the telescopic joint of FIG. 1, taken along the line 2—2 of FIG. 1.
Figure 3:
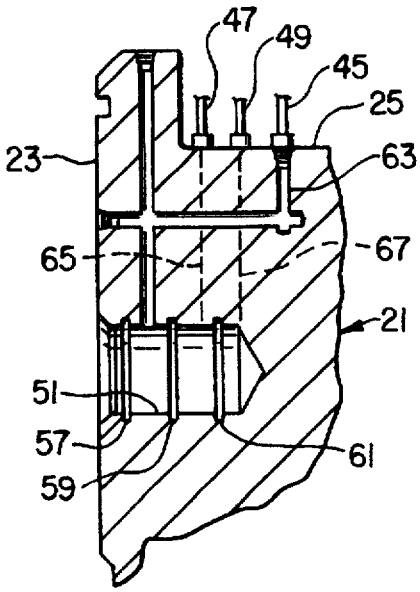
FIG. 3 is a partial sectional view of a portion of the telescopic joint of FIG. 1, taken along the line 3—3 of FIG. 2.

Referring to FIG. 2, mandrel 21 has two control ports 51, 53 located at its cylindrical exterior 23. In the embodiment shown, ports 51, 53 are located 180 degrees apart. Referring to FIG. 3, port 51 comprises a multi-purpose receptacle. It has three seals 57, 59 and 61 located within it to divide port 51 into three separate zones. A fluid passage 63 extends from mandrel upper side 25 to the zone between seals 57, 59. Passage 63 is connected to fluid line 45 for supplying cooling fluid. A fluid line 65 intersects port 51 between seals 59 and 61. Passage 65 is connected to upper packer line 47 for delivering air pressure. A passage 67 is connected between the base of control port 51 and seal 61. Fluid passage 67 is connected to lower packer line 49 for delivering hydraulic fluid to energize lower packer 29.

Figure 7:
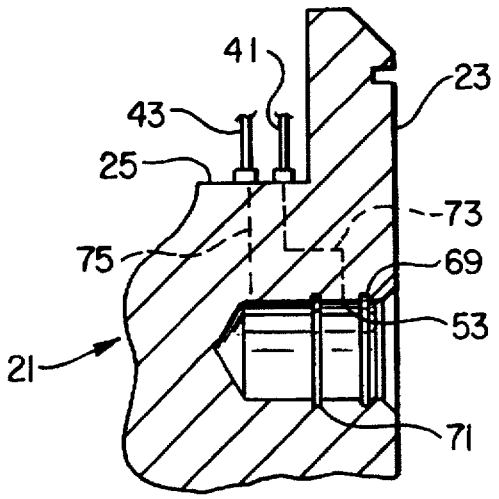
FIG. 7 is a partial sectional view of the telescopic joint of FIG. 1, taken along the line 7—7 of FIG. 2.

Similarly, FIG. 7 illustrates multi-purposes for control port 53. Control port 53 has two seals 69, 71. A hydraulic passage 73 intersects the space between seals 69, 71 and leads to locking dogs extension line 41. Passage 75 intersects cavity 53 between its base and its seal 71. Passage 75 leads to locking dogs retraction line 43. Supplying hydraulic fluid to line 41 causes locking dogs 33 to (FIG. 1) to extend. Supplying hydraulic fluid to line 43 causes locking dogs 33 (FIG. 1) to retract.

Figure 4:
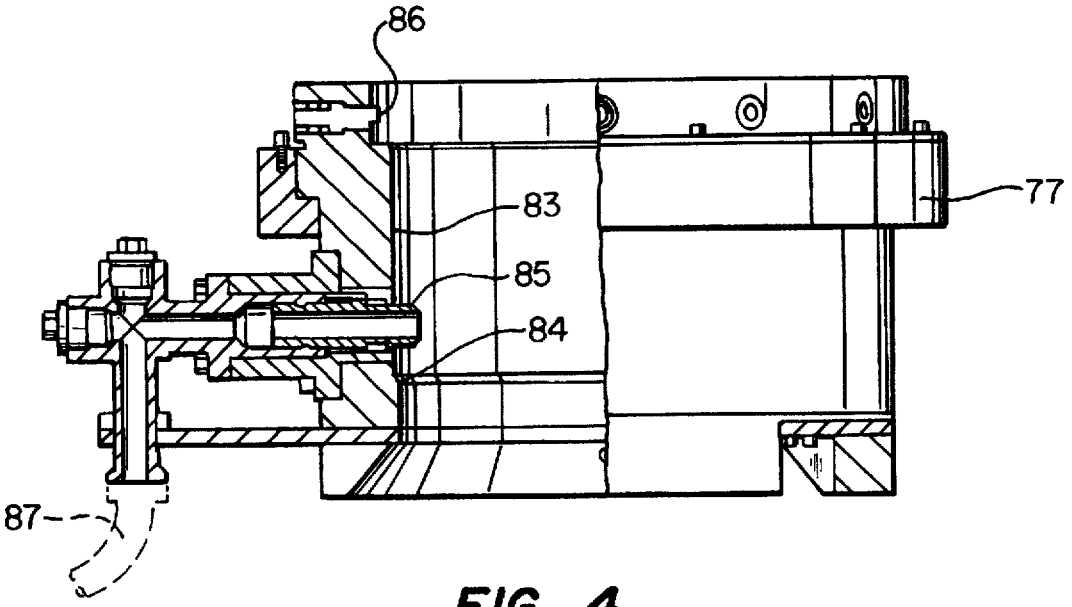
FIG. 4 is a partial sectional view of a support ring constructed in accordance with this invention.

A support ring 77 is shown in FIG. 4. Support ring 77 has a plurality of lugs 79 for connection to cables leading to automatic tension equipment (not shown) on the drilling vessel. Support ring 77 has a bore 83 with a shoulder 84 onto which mandrel 21 lands. The automatic tension equipment applies an upward pull of constant magnitude on support ring 77 to apply tension to riser 35 (FIG. 1 ). A plurality of stabs 85 are mounted to support ring 77 for extension into bore 83 to mate with the well control ports 39 (FIG. 1). Stabs 85 will retract when mandrel 21 is outside of bore 83. Stabs 85 are connected to hoses 87 which lead to the vessel for supplying well control fluids. Support ring 77 also has hydraulically actuated latches 86 (FIG. 4) for latching mandrel 21 in bore 83.

Figure 5:
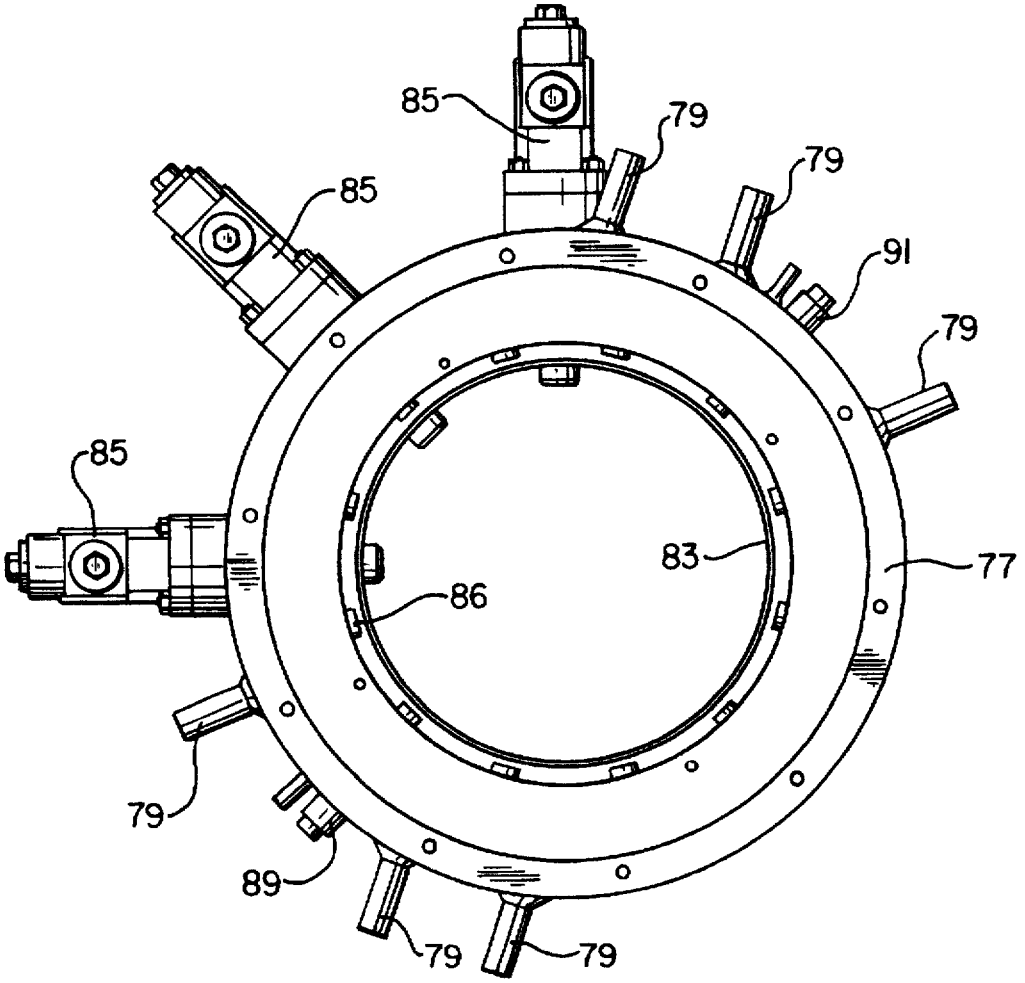
FIG. 5 is a top plan view of the support ring of FIG. 1.
Figure 6:
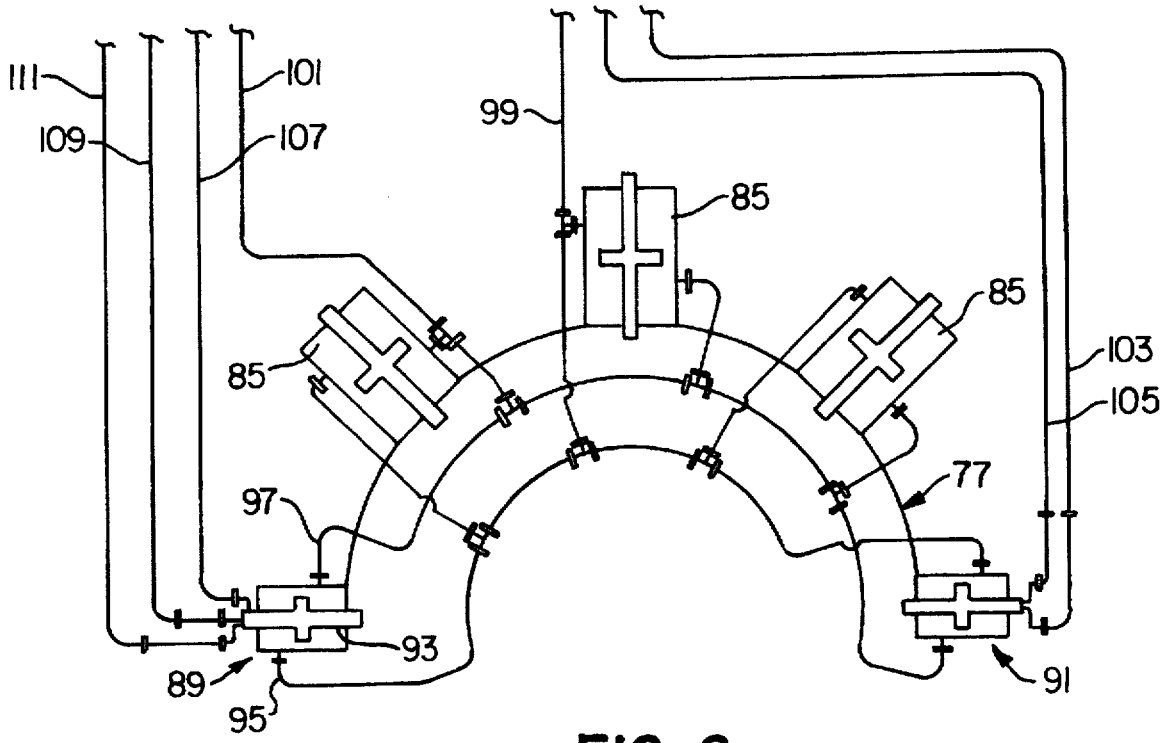
FIG. 6 is a piping schematic illustrating connection of the various lines to the support ring of FIG. 4.

Similarly, there are two stabs 89, 91, shown in FIG. 5, which are employed to engage telescopic joint control ports 51, 53 (FIG. 2). Referring to the schematic of FIG. 6, each stab 89, 91 has a tube 93 which will move between a radially inward or extended position and a retracted position. Each tube 93 is driven inward by hydraulic fluid pressure supplied through a line 95. Each tube 93 is retracted from support ring bore 83 by supplying hydraulic fluid pressure to line 97. Lines 95, 97 also extend and retract stabs 85. Lines 95, 97 are connected to the hoses 99, 101 which lead to a manifold (not shown) on the vessel.

Two hoses 103, 105 are connected to respective passages in stab 91. Hose 103 will deliver hydraulic fluid to locking dogs extension line 41 (FIGS. 1, 7). Hose 105 will deliver hydraulic fluid to locking dogs retraction line 43 (FIGS. 1, 7). Hoses 107, 109 and 111 are connected to stab 89. Hoses 107, 109, 111 are arranged to deliver fluids to control lines 45, 47 and 49 (FIG. 3) respectively.

In operation, the various hoses 103, 105, 107, 109, and 111 (FIG. 6) will be connected to support ring 77 (FIGS. 4, 5), and it will be suspended by cables with riser 35 passing through support ring 77. Control lines 41, 43, 45, 47 and 49 will already be connected between the various ports on outer barrel and mandrel 21 before it is lowered onto support ring 77. Control lines 41, 43, 45, 47, 49 normally need not be disconnected when telescoping joint 11 is stored between usages. Locking dogs 33 will be in the extended position, locking inner barrel 13 and outer barrel 19 in the contracted position. The operator connects mandrel 21 to the upper end of riser 35 while the riser is supported at the rig floor of the vessel. He then lowers telescopic joint 11 and riser 35 until mandrel 21 lands in support ring 77. Mandrel 21 will be oriented so that its ports 51, 53 radially align with stabs 89, 91, and it will be latched in place by supplying hydraulic fluid pressure to latches 86.

The operator supplies hydraulic fluid through hose 99 (FIG. 6 ) to cause the stabs 89, 91 to extend into sealing engagement with control port receptacles 51, 53 (FIG. 2). At the same time, stabs 85 wilt extend into sealing engagement with well control fluid ports 39 (FIG. 1.). The operator will supply hydraulic fluid to hose 105 (FIG. 6) which leads to control line 43 (FIG. 7) to cause locking dogs 33 (FIG. 1) to retract. This frees inner barrel 13 to move axially relative to outer barrel 19.

Wave movement causes vertical movement of inner barrel 13 while outer barrel 19 remains stationary. For cooling, the operator supplies water to hose 107 which flows through line 45 (FIGS. 1, 3) to cool the interface between inner barrel 13 and outer barrel 19. In the event that it is necessary to seat between inner barrel 13 and outer barrel 19, one or both of the packers 27, 29 may be energized. In the embodiment shown, air pressure is supplied through hose 109, which leads to control line 47 to energize upper packer 27. Hydraulic pressure may be supplied though hose 111, which flows through control line 49 to energize lower packer 29. Relieving the pneumatic and hydraulic pressure in hoses 109, 111 allows packers 27, 29 to retract.

Subsequently, when telescopic joint 11 is to be removed, inner barrel 13 will be lowered into a contracted position shown in FIG. 1, and locking dogs 33 will be locked by supplying hydraulic fluid to hose 103 (FIG. 6), which delivers hydraulic fluid to control line 41 to cause locking dogs 33 to extend. The operator unlatches mandrel 21 from support ring 77 by supplying hydraulic fluid pressure to latches 86. The operator retracts stabs 85 as well as stabs 89, 91 by supplying hydraulic fluid pressure to hose 101. The operator then picks up telescoping joint 11 as a unit without having to manually disconnect control lines 41, 43, 45, 47, and 49. The invention has significant advantages. The telescopic joint is installed and retracted without the need for placing a worker below the rig floor to connect the various lines. This avoids danger to the worker and reduces the mount of time needed to connect the telescopic joint.

While the invention is being shown in only one of its forms, it should be apparent to those skilled in the art that it is not so limited, but is suspectable to various changes without departing from the scope of the invention.

I claim:

1. A telescopic joint assembly for use with a riser extending between a subsea wellhead and a vessel, comprising in combination:

an outer barrel;

an inner barrel carded within the outer barrel for vertical movement relative to the outer barrel due to wave movement;

a mandrel on a lower end of the outer barrel and adapted to secure to the upper end of a riser, the mandrel having a circumferential exterior wall;

a plurality of control fluid passages in the mandrel, each having an inlet at the exterior wall and an outlet located above the inlet;

a plurality of control fluid lines connected between the outlets of the control fluid passages and the outer barrel for supplying control fluids to the outer barrel; and a support ring adapted to be suspended from the vessel and having a bore in which the mandrel lands to provide support for the upper end of the riser, the support ring having a plurality of control fluid passages which are adapted to be connected to a plurality of control fluid hoses extending from the vessel, the control fluid passages of the support ring each having an outlet in the bore which mates with one of the inlets in the mandrel to supply control fluid to the outer barrel.

2. The telescopic joint assembly according to claim 1 further comprising:

a packer carried by the outer barrel, having a retracted position and an energized position for sealingly engaging the inner barrel; and wherein one of the control fluid lines supplies one of the control fluids to the packer to cause it to move to the energized position.

3. The telescopic joint assembly according to claim 1 further comprising:

a pneumatically actuated packer carded by the outer barrel, having a retracted position and an energized position for sealingly engaging the inner barrel;

a hydraulically actuated packer carried by the outer barrel, having a retracted position and an energized position for sealingly engaging the inner barrel; wherein one of the control fluid lines is adapted to supply pressurized air as one of the control fluids to the pneumatically actuated packer to cause it to move to the energized position; and another one of the control fluid lines is adapted to supply hydraulic fluid as one of the control fluids to the hydraulically actuated packer to cause it to move to the energized position.

4. The telescopic joint assembly according to claim 1, wherein one of the control fluid lines is adapted to supply a cooling liquid as one of the control fluids to an interface between the inner and outer barrels.

5. The telescopic joint assembly according to claim 1 further comprising:

a locking member mounted to the outer barrel, having a released position and an engaged position in engagement with the inner barrel to selectively prevent axial movement of the inner and outer barrels relative to each other; and one of the control fluid lines leads to the locking member and is adapted to supply one of the control fluids to the locking member to move it between the released and engaged positions.

6. The telescopic joint assembly according to claim 1, further comprising:

at least one receptacle on the exterior wall of the mandrel;

at least one stab mounted to the support ring for movement from a retracted position to an extended position in engagement with the receptacle; and wherein the inlets of a plurality of the control fluid passages of the mandrel are within the receptacle; and the outlets of a plurality of the control fluid passages of the support ring are located on the stab.

7. A telescopic joint assembly for use with a riser extending between a subsea wellhead and a vessel, comprising in combination:

an outer barrel;

an inner barrel carried telescopingly within the outer barrel, having an upper end connected to a conduit which extends upward for connection to the vessel;

a packer mounted to the outer barrel, having a retracted position and an energized position for sealing against the inner barrel;

a locking member mounted to the outer barrel, having a released position and an engaged position in engagement with the inner barrel to selectively prevent telescoping movement of the inner barrel relative to the outer barrel;

a mandrel on a lower end of the outer barrel and which is adapted to secure to the upper end of the riser, the mandrel having a circumferential exterior wall;

a packer passage having an inlet in the wall and an outlet located above the inlet of the packer passage;

a locking member passage having an inlet in the wall and an outlet located above the inlet of the locking member passage;

a packer fluid line connected between the packer and the outlet of the packer passage exterior of the outer barrel;

a locking member fluid line connected between the locking member and the outlet of the locking member passage exterior of the outer barrel;

a support ring adapted to be suspended from the vessel and having a bore which receives the exterior wall of the mandrel to provide support for the upper end of the riser;

the support ring having a packer passage which has an inlet adapted to be connected to a packer fluid supply hose extending from the vessel and an outlet in the bore which mates with the inlet of the packer passage in the mandrel to supply fluid to the packer to move it between the retracted and engaged positions; and the support ring having a locking passage which has an inlet adapted to be connected to a locking fluid supply hose extending from the vessel and an outlet in the bore which mates with the inlet of the locking member passage in the mandrel to supply fluid to the locking member to move it between the released and engaged positions.

8. The telescopic joint assembly according to claim 7, wherein each of the inlets of the mandrel is located within a receptacle, and each of the outlets of the support ring comprises:

a fluid actuated stab which inserts into one of the receptacles after the mandrel has located within the support ring.

9. The telescopic joint assembly according to claim 7 wherein the fluid which moves the packer to the engaged position is hydraulic fluid, and wherein the telescopic joint further comprises:

a pneumatically actuated packer carried by the outer barrel, having a retracted position and an energized position for sealingly engaging the inner barrel;

a pneumatic passage in the mandrel, having an inlet in the wall and an outlet located above the inlet of the pneumatic passage;

a pneumatic line connected between the pneumatic packer and the outlet of the pneumatic passage exterior of the outer barrel; and a pneumatic passage in the support ring which has an inlet adapted to be connected to a pneumatic supply hose extending from the vessel and an outlet in the bore which mates with the inlet of the pneumatic passage in the mandrel to supply air pressure to the pneumatic packer to move it between the retracted and engaged positions.

10. The telescopic joint assembly according to claim 7, further comprising:

a coolant fluid passage in the mandrel, having an inlet in the exterior wall and an outlet located above the inlet of the coolant fluid passage;

a coolant fluid line extending exterior of the outer barrel from an interface between the inner and outer barrels to the outer of the coolant fluid passage;

a coolant fluid passage in the support ting having an inlet adapted to be connected to a coolant fluid supply hose extending from the vessel and having an outlet in the bore which mates with the inlet of the coolant fluid passage in the mandrel to supply cooling fluid to the interface.

11. A method for installing and operating a telescopic joint for a riser extending between a subsea wellhead and a vessel, the telescopic joint having an outer barrel, an inner barrel carried telescopingly within the outer barrel and connected to a conduit extending upward into engagement with the vessel, a mandrel on a lower end of the outer barrel which secures to the upper end of the riser, the mandrel having a circumferential exterior wall and adapted to land in a support ring suspended from the vessel which has a bore for receiving the exterior wall of the mandrel to provide support for the upper end of the riser, the method comprising:

(a) providing a plurality of control fluid passages in the mandrel, each having an inlet at the exterior wall and an outer located above the inlet;

(b) connecting a plurality of control fluid lines between the outlets of the control fluid passages and the outer barrel;

(c) providing a plurality of control fluid passages in the support ring and connecting them to a plurality of control fluid hoses extending from the vessel, the control fluid passages of the support ring each having an outlet in the bore;

(d) connecting the mandrel to an upper end of the riser and lowering the mandrel into the support ring with the outlets of the control fluid passages in the support ting oriented with the inlets of the control fluid passages in the mandrel; then (e) supplying control fluid through the control fluid hoses to control the telescopic joint.

12. The method according to claim 11 wherein step (b) comprises connecting one of the control fluid lines to a packer carried by the outer barrel; and step (e) comprises supplying a control fluid through one of the control fluid hoses to the packer to cause it to sealingly engage the inner barrel.

13. The method according to claim 11 wherein step (b) comprises connecting one of the control fluid lines to a pneumatic packer carried by the outer barrel and another one of the control fluid lines to a hydraulic packer carried by the outer barrel; and step (e) comprises supplying pressurized air as one of the control fluids through one of the control fluid hoses to the pneumatic packer to cause it to sealingly engage the inner barrel, and supplying pressurized hydraulic fluid as another one of the control fluids through another one of the control fluid hoses to the hydraulic packer to cause it to sealingly engage the inner barrel.

14. The method according to claim 11, wherein step (b) comprises connecting one of the control fluid lines to an interface between the inner and outer barrels; and step (e) comprises supplying a cooling liquid as one of the control fluids through one of the control fluid hoses to the interface between the inner and outer barrels.

15. The method according to claim 11, wherein step (b) comprises connecting one of the control fluid lines to a locking member mounted to the outer barrel; and step (e) comprises supplying hydraulic fluid pressure as one of the control fluids through one of the control fluid hoses to the locking member to lock the inner and outer barrels together.

* * * * *

UNITED STATES PATENT AND TRADEMARK OFFICE

CERTIFICATE OF CORRECTION

PATENT NO. : 5,727,630
DATED : March 17, 1998
INVENTOR(S) : Ashley N.M. Brammer

It is certified that error appears in the above-identified patent and that said Letters Patent is hereby corrected as shown below:

Column 4, Line 58, "carded" should be --carried--;

Column 5, Line 24, "carded" should be --carried--;

Column 7, Line 14, "ting" should be --ring--;

Column 8, Line 5, "ting" should be --ring--.

Signed and Sealed this

Tenth Day of November 1998

*Attest:*

*Attesting Officer*

BRUCE LEHMAN

*Commissioner of Patents and Trademarks*